US006016130A

United States Patent [19]

Annamaa

[11] Patent Number: 6,016,130

[45] Date of Patent: Jan. 18, 2000

[54] DUAL-FREQUENCY ANTENNA

[75] Inventor: Petteri Annamaa, Oulu, Finland

[73] Assignee: LK-Products Oy, Kempele, Finland

[21] Appl. No.: 08/915,953

[22] Filed: Aug. 21, 1997

[30] Foreign Application Priority Data

Aug. 22, 1996 [FI] Finland ..... 963275

[51] Int. Cl.[7] ..... H01Q 1/24

[52] U.S. Cl. ..... 343/895; 343/702; 343/725

[58] Field of Search ..... 343/895, 702, 343/725, 726, 727, 728, 711

[56] References Cited

U.S. PATENT DOCUMENTS 4,137,534 5/1977 Goodnight ..... 343/752
5,734,351 3/1998 Ojantakanen et al. .

FOREIGN PATENT DOCUMENTS 98165 12/1996 Finland .
2 206 243 12/1988 United Kingdom ..... H01Q 5/00

*Primary Examiner*—Don Wong
*Assistant Examiner*—James Clinger
*Attorney, Agent, or Firm*—Darby & Darby

[57] ABSTRACT

An antenna structure for two frequency ranges including two antenna elements. The first antenna element is a cylindrical coil conductor (2) forming a helical antenna and includes in the direction of its longitudinal axis, a first portion (2*a*) and a second portion (2*b*). The second antenna element (3; 6) is connected to the cylindrical coil conductor by a fixed connection at a junction (2*c*) lying between the first and second portions of the first antenna element. The second antenna element may be for example, a filamentous conductor (5*a*), a conductive pattern (5) formed on the surface of an insulating plate (3), or a small-diameter helical antenna (6). The first operating frequency is dependent on the combined electrical length of the portions of the first antenna element while the second operating frequency is dependent on the combined electrical length of the lower part of the first antenna element and the second antenna element. The bandwidth of the operating frequencies is dependent on the positioning of the junction in the first antenna element.

35 Claims, 4 Drawing Sheets

DUAL-FREQUENCY ANTENNA

BACKGROUND OF THE INVENTION

1. Field of the Invention

The invention relates to an antenna structure which has two resonant frequency bands or which may be used as the antenna of a radio set in two frequency ranges.

2. Description of Related Art

In different parts of the world cellular telephone systems are in operation with operating frequency ranges which differ significantly one from another. Among the digital cellular telephone systems, the operating frequencies of the GSM (Global System for Mobile Telecommunications) system are in the 890–960 MHz band, those of JDC (Japanese Digital Cellular) 800 and 1500 MHz band, those of the PCN (Personal Communication Network) are in the 1710–1880 MHZ band and those of the PCS (Personal Communication System) in the 1850–1990 MHz band. The operating frequencies of the American AMPS mobile telephone system are 824–894 MHz and the operating frequencies of the DECT (Digital European Cordless Telephone) system are 1880–1900 MHz.

In the mobile telephones designed for these systems, use is generally made of simple cylindrical coil or helical antennae or whip antennae formed from a straight conductor on account of their low manufacturing costs and their relatively good performance. The resonant frequency of an antenna is determined by its electrical length, which should be a specific part of the wavelength of the radio frequency used. The electrical length of a helical antenna used at mobile telephone frequencies should preferably be, for example, $3\lambda/8$, $5\lambda/8$ or $\lambda/4$, where $\lambda$ is the wavelength in use. Similarly, the electrical length of a whip antenna should preferably be, for example, $\lambda/2$, $5\lambda/8$, $3\lambda/8$ or $\lambda/4$. Solutions are also known where the whip- or helical element may be connected in turn to the antenna port of the radio set, and whip-helix series connections which may be pushed partially inside the telephone, for example, as described in International Patent No. WO-92/16980.00. Technical solutions generally involve an attempt to ensure that the antenna is as small as possible during storage and transport, but it may be necessary to pull the antenna out to its external position in order to obtain a better link.

Since the resonant frequency of the antenna according to the prior art is, as has been shown, related to the length of the antenna via the wavelength, it is only possible to use a certain antenna in a mobile telephone that is designed for a cellular telephone system with a single frequency range. In some cases, however, one may wish to use the same telephone in some second frequency range. Then an effective antenna solution is required in addition to the appropriate RF components.

The easiest solution would be to provide the telephone with at least two separate antennae, from which the user can always select for his telephone the antenna which corresponds to the frequency range of the system in use at any time. It has to be assumed, however, that the necessary alternative antenna is generally missing. Continual exchange of the antenna also overtaxes the antenna connector and may over time cause contact disturbances. The second option would be to manufacture at least two fixed antennae of differing dimensions for different points of the telephone, in which case the user would select an antenna by switching into operation the one which corresponded to the frequency range of the system in use. This would add to the number of telephone components and thus increase the manufacturing costs.

U.S. Pat. No. 4,442,438 presents an antenna structure resonating at two frequencies, which essentially consists of two helices HX1, HX2 and one whip element P1, as shown in FIG. 1. The helices HX1 and HX2 are positioned in succession parallel with the axis of symmetry of the structure and their adjacent ends A1 and A2 form the feed point of the combined structure. The whip element P1 lies partially inside the upper helix HX1, projecting to some extent beyond this and its feed point A3 is at the bottom end. The RF signal is carried to the feed point in question A3 via the coaxial conductor KX which lies along the axis of symmetry of the structure and goes through the lower helix HX2. The feed point A3 of the whip element is joined to the lower end A1 of the upper helix and the lower helix is joined at its upper end A2 to the conductive and earthed mantle of the coaxial conductor KX. The first resonating frequency of the structure is the resonating frequency of the combined structure formed by helices HX1 and HX2, which in the embodiment given as an example is 827 MHz. The second resonating frequency of the structure is the common resonating frequency of upper helix HX1 and whip element P1, which in the embodiment in the example is 850 MHz. The helix HX1 and the whip element P1 are thus so designed that they have essentially the same resonating frequency.

The structure presented in this patent is relatively complex and its physical length in the direction of the axis of symmetry is the sum of the physical lengths of the lower helix HX2 and the whip element P1. The greatest drawback of the structure with regard to manufacturing technology is the feed point arrangement at the midpoint of the antenna, where the lower end A3 of the whip element and the lower end A1 of the upper helix have to be in galvanic connection and the lower helix has to be joined at its upper end A2 to the mantle of the coaxial conductor which feeds the whip element. The difference between the two resonating frequencies which are to be attained by the structure is, according to the material presented in the patent, small, since the upper helix H1 and the whip element P1 have to be so dimensioned that they have essentially the same common resonating frequency, so that this antenna cannot for example be used for a telephone operating at GSM and PCN frequencies.

SUMMARY OF THE INVENTION

An object of the present invention is to widen the resonance frequency range of the mobile telephone antenna so that it best covers substantially all of the frequency band in one cellular telephone system. The present invention is a dual-frequency antenna which is relatively easy to manufacture and which can be dimensioned as desired for two different frequency ranges.

The aims of the present invention are attained with an antenna structure in which, at a certain point between the ends of a helical antenna which is wound to form a cylindrical coil conductor, there is a junction for connection of a second antenna element.

The antenna in accordance with the present invention includes a cylindrical coil conductor, which is the first antenna element, comprises in the direction of its longitudinal axis a first portion and a second portion, and a second antenna element is connected to the cylindrical coil conductor by a fixed connection at a junction lying between the first and second portions.

It has been recognized that the two radiating antenna elements may have a common lower part up to a specific point of divergence, above which the electrical lengths of the antenna elements are different. The terms lower and upper part refer to the position in which the antennae are generally depicted in a technical drawing, and do not impose restrictions on the manufacture of an antenna according to the invention or limit its use in any particular direction. The first resonant frequency of the combined antenna structure is determined by the combined electrical length of the common lower part of the antenna elements and the upper part of the first antenna element. The second resonant frequency is determined correspondingly by the combined electrical length of the common lower part and the upper part of the second antenna element. The resonant frequencies are also affected by the interconnection between the antenna elements and by the fact that the antenna elements are electrically conductive components in each other's near field, so that they charge one another.

There are many reasons why it is worth choosing a helical antenna as the first antenna element in the antenna structure in accordance with the present invention. First, the manufacture and fixing of a helical antenna to the connector element, which is attached to the radio set, is rendered relatively easy by applying, for example, the procedure described in Finnish Patent Application No. 951670. Second, the physical length of the helical antenna is fairly small in relation to its electrical length or to the electrical length of a whip antenna of similar performance at the same frequency, which is advantageous particularly in relatively small radio sets such as mobile telephones. Third, the helical antenna is naturally flexible, which makes it mechanically durable. It is also simple to produce, for a helical antenna, a junction which corresponds to the above-mentioned divergence point and to which the second antenna element of the dual-frequency antenna in accordance with the present invention may be connected. The junction may be a cylindrical or lamellar component situated inside the helix or part of a helical winding which is wound more tightly than the rest of the helix.

The second antenna element is selected so that its connection to the junction, which is formed by the helical antenna, is relatively simple and its design suits both the physical dimensions and the functioning of the antenna structure. A useful option is the whip antenna or straight conductor, which may be a piece of fairly rigid filamentous conductor or, for example, a conductive pattern formed on the surface of an insulating plate. The whip antenna does not need to be absolutely straight, but may be bent in order to shorten the physical length of the structure. For the second antenna element a relatively small-diameter helical element.

BRIEF DESCRIPTION OF THE DRAWING

The invention is explained in greater detail below with reference to favourable embodiments and attached drawings which are presented by way of example, where the same reference numbers refer to the same elements.

DESCRIPTION OF THE PREFERRED EMBODIMENTS

Figure 1:
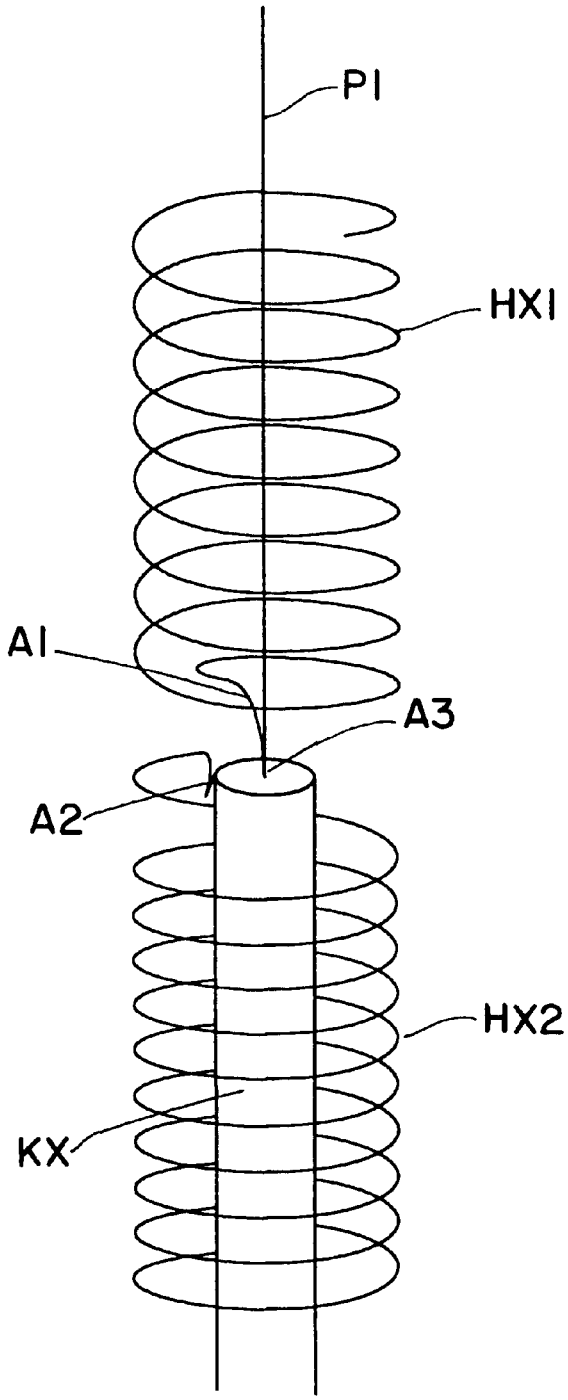
FIG. 1 PRIOR ART
FIG. 1 is a prior art antenna structure.
Figure 2A:
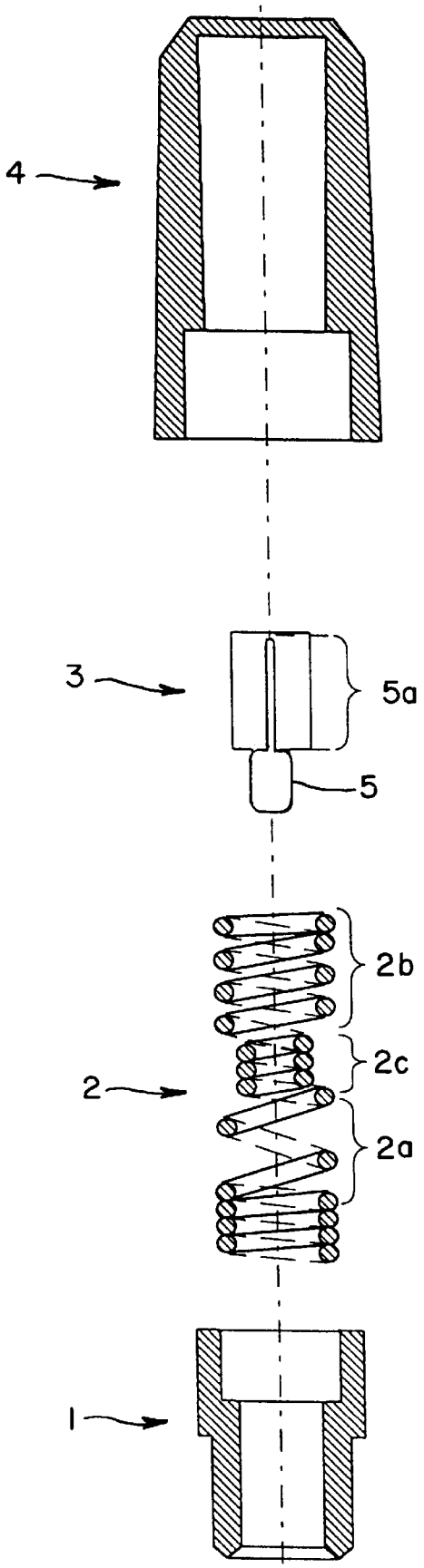
FIG. 2*a* is an exploded view of a first embodiment of the antenna in accordance with the present invention.
Figure 2B:
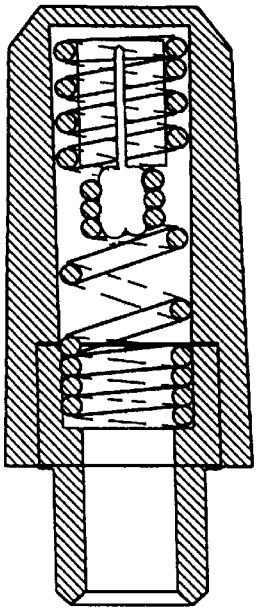
FIG. 2*b* is an assembled view of the embodiment in FIG. 2*a*.
Figure 2C:
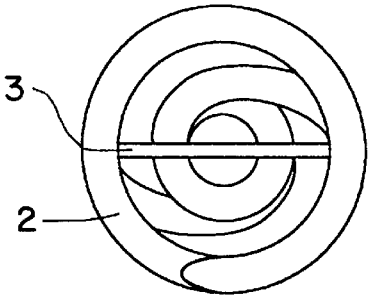
FIG. 2*c* is another view of the antenna elements in FIGS. 2*a* and 2*b*.

FIG. 2*a* is an exploded view, and elements 1, 2 and 4 show the antenna structure in longitudinal section, where 1 is a connector, 2 is a helical element, 3 is an insulating plate provided with a conductive pattern and 4 is a protective sheath made from an insulation material. The structure is assembled by attaching helical element 2 to connector 1 in a known manner, by pushing insulating plate 3 inside the helical element and pressing protective sheath 4 onto the assembled structure, thus forming an assembled antenna as shown in FIG. 2*b*. The connector 1 is made from metal or another electrically conductive material, and on the outside of the sleeve-like lower part there is a screw thread for effective attachment of the antenna to the radio set (not shown in the Figure). FIG. 2*c* is a top view of the assembled helical element and insulating plate showing the arrangement of the insulating plate 3 inside the helical element 2.

On the surface of insulating plate 3 there is a conductive pattern 5, which on the lower part of the plate extends to the edges of the plate and on the upper part of the plate forms a straight conductor, so that it is possible to call it a whip element 5*a*. When the plate is attached to the helical element in accordance with FIG. 2*b*, the lower part of the conductive pattern contacts at its edges the more tightly wound portion in the middle of the helix, which is marked with reference number 2*c*. In order to ensure electrical conductivity, the edges of the conductive pattern may be soldered fast to the helical wire at point 2*c*. In an alternative embodiment, in which galvanic contact between conductive pattern 5 and the helical element 2 is not required, the conductive pattern does not need to extend to the edges of insulating plate 3. In that case, the lower part of the whip element is connected to the junction of the helical element capacitively. Below the junction there is a portion of the helix marked with reference number 2*a*, and above the junction there is the portion of helix marked with reference number 2*b*. The turns of the helix connected to the connector 1 are not included in portion 2*a*, since the electrically conductive connector short-circuits these turns and they do not act as a radiating part of the antenna. The upper part of the insulating plate 3 may be wider than lower part thereof, as in the Figure, in which case its edges support the upper part 2*b* of the helix, or it may be of equal width, or of some other shape.

The parameters which are of central importance for the design and functioning of the antenna are the number of turns in the lower part 2*a* and the upper part 2*b* of the helix and the position of the junction 2*c* to which the conductive pattern 5 of specific length is connected. The dimensioning of the helix (diameter of the helix and the number of turns in lower part 2*a* and the number of turns in upper part 2*b*of the helix) determines the lower operating frequency of the antenna. Helix 2 is so designed that it is, charged by whip element 5*a*, in tune with the lower operating frequency of the antenna, for example the GSM- or AMPS frequencies. The dimensioning of whip element 5*a* in proportion to junction 2*c* determines the upper operating frequency of the antenna, which is determined by the proportion of the helix which is in its lower part 2*a* and by the length of the whip element 5*a*. At the upper operating frequency the radiating antenna element is a connection in series of the lower part 2*a* of the helix and the whip element.

The bandwidth of the operating frequencies is determined by the position of junction 2*c* or by the dimensional ratio of lower part 2*a* and upper part 2*b* of the helix. If the junction 2*c* is shifted downwards in the helix or the number of turns in the lower part 2*a* of the helix is reduced, the bandwidth of the higher operating frequency increases and the bandwidth of the lower operating frequency correspondingly decreases. If the junction 2*c* is shifted upwards or the number of turns in the lower part 2*a* of the helix increases in relation to the upper part 2*b* of the helix, the bandwidth of the higher operating frequency decreases and the bandwidth of the lower operating frequency increases. By means of the position of the junction 2*c*, by the dimensioning of lower part 2*a* and upper part 2*b* of the helix and by selection of the length of whip element 5*a*, the operating frequencies and bandwidths of the antenna may be adjusted for desired system pairs. The selection of dimensions by trial and error is in itself a technique known to those skilled in the art.

Figure 3:
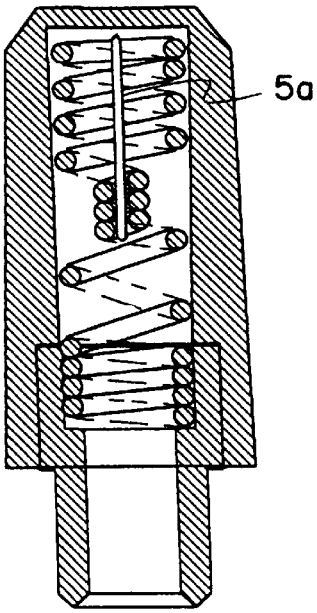
FIG. 3 is a second embodiment of the antenna in accordance with the present invention.

FIG. 3 shows, in partial longitudinal section, a second embodiment in accordance with the present invention, which differs from the embodiment shown in FIGS. 2*a* –2*c* in that, instead of being an insulating plate with a conductive pattern formed thereon, whip element 5 is a straight piece of filamentous conductor. The junction 2*c* of the helix is wound with a smaller diameter than in the embodiment shown in FIGS. 2*a*–2*c*, so that the whip element 5*a* may be pushed to the middle of the junction 2*c*. If the whip element is thick enough and the diameter of the junction 2*c* is small enough, the whip element may be attached in place simply by the effect of friction between it and the helix wire. The connection may also be ensured by soldering, by adhesion, or by some other suitable procedure. If the whip element 5*a* is coated with an insulating material, friction attachment or adhesion will be involved. In that case, electrical connection between the helix and the whip element is capacitive. The insulation coating may of course also be removed from below the whip element before attachment, in which case the connection will be galvanic.

Figure 4:
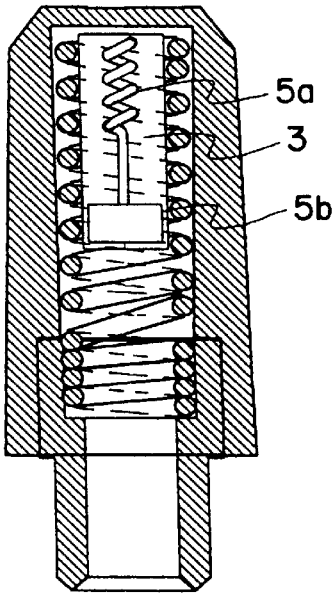
FIG. 4 is a third embodiment of the antenna in accordance with the present invention.

FIG. 4 shows an embodiment of the invention in which the whip element 5*a* formed on insulating plate 3 is not straight but forms a zig-zag pattern at the top. Such a solution is applicable when the desired higher frequency of the antenna necessitates such a large electrical length of the whip element that in the direction of the longitudinal axis of the structure it would extend considerably further (upwards in the drawing) than the helical element. Nothing of course prevents the whip element from extending further than the helical element, but the structure will be more compact if its length can be kept as small as possible. The helix in the embodiment in FIG. 4 does not have a junction with turns of smaller diameter, but the insulating plate 3 is throughout as wide as the internal diameter of the helix, and the whip element is connected capacitively via a widening 5*b* to the midpoint of the helix.

Figure 5:
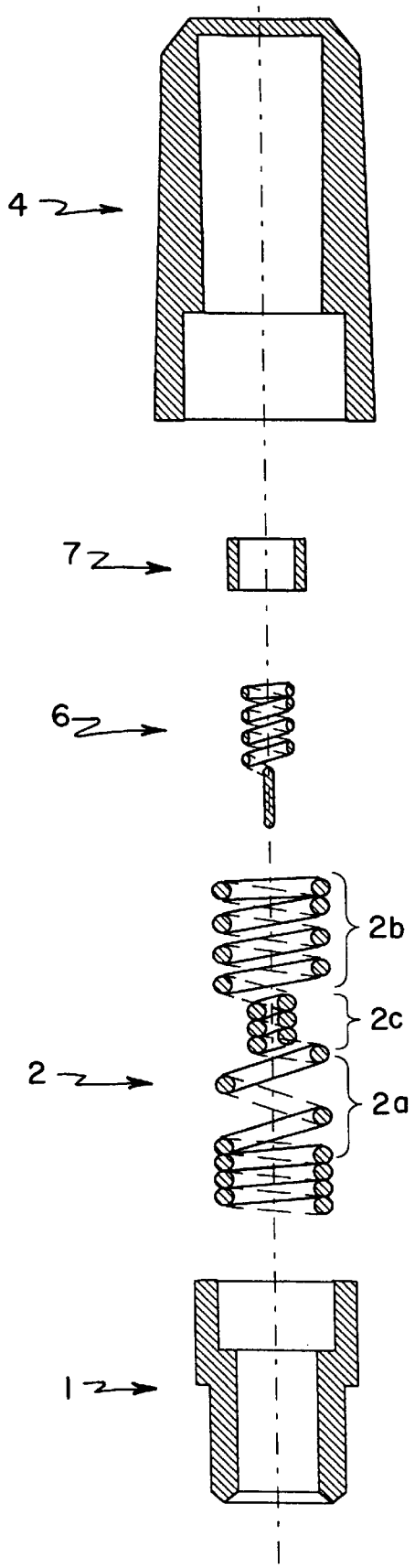
FIG. 5 is a fourth embodiment of the antenna in accordance with the present invention.

FIG. 5 is an exploded view in longitudinal section of the components of an embodiment of this invention, in which the antenna element 6 designed for the higher operating frequency is not a whip element but a helical element so small in diameter that it fits into the upper part 2*b* of the larger helix. When the antenna bends, however, the helices may strike each other, in which case functioning of the antenna is disturbed. This may be avoided by positioning around the smaller helix 6 a sleeve 7 made of an insulating material, the internal diameter of which is the same as the external diameter of the smaller helix 6 and the external diameter of which is the same as the internal diameter of the upper part 2*b* of the larger helix.

The above embodiments are intended only as examples, and it will be clear to those skilled in the art that the details of the embodiments of the invention may vary, and thus realization of the invention lies within the scope of the patent claims below. The present invention is not restricted to any specific application but may be employed in antennae for different applications and at different frequencies, preferably at radio frequencies, such as UHF and VHF. The structure is suitable for use for mobile telephones.

I claim:

1. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, said second antenna element being oriented in the same direction from said junction as said second portion of said cylindrical coil conductor and a physical length of said second antenna element in said direction is substantially the same as a physical length of said second portion is said direction.

2. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, said second antenna having an end disposed proximate the junction, said second antenna element being oriented in the same direction from said junction as said second portion of said cylindrical coil conductor, and a physical length of said second antenna element in said direction is substantially the same as a physical length of said second portion is said direction.

3. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, and the first portion of said cylindrical coil conductor having a first end as a feed point connection of said antenna, said second antenna element being oriented in the same direction from said junction as said second portion of said cylindrical coil conductor, and a physical length of said second antenna element in said direction is substantially the same as a physical length of said second portion is said direction.

4. An antenna for the transmission and reception of radio-frequency oscillation at a first operating frequency and a second operating frequency different from said first operating frequency, comprising:

a cylindrical coil conductor forming a helical antenna and having a longitudinal axis, said cylindrical coil conductor including a first portion and a second portion, said first and second portions being disposed along said longitudinal axis and each having an electrical length, wherein the first operating frequency is dependent on the combined electrical length of said first and second portions; and a second antenna element having an electrical length, said second antenna element being fixedly connected to said cylindrical coil conductor at a junction disposed between said first and second portions of said cylindrical coil conductor; and the second operating frequency is dependent on the combined electrical lengths of the first portion and said second antenna element, said second antenna element being oriented in the same direction from said junction as said second portion of said cylindrical coil conductor, and a physical length of said second antenna element in said direction is substantially the same as a physical length of said second portion is said direction.

5. An antenna in accordance with claim 4, wherein a bandwidth of the first operating frequency and a bandwidth of the second operating frequency are dependent on positioning of said junction in said cylindrical coil conductor along said longitudinal axis.

6. An antenna in accordance with claim 5, wherein the bandwidth of the first operating frequency decreases while the bandwidth of the second operating frequency increases as said junction is shifted along the longitudinal axis towards the first portion.

7. An antenna in accordance with claim 5, wherein the bandwidth of the first operating frequency increases while the bandwidth of the second operating frequency decreases as said junction is shifted along the longitudinal axis towards the second portion.

8. An antenna in accordance with claim 1, wherein said second antenna element is oriented in the same direction from said junction as the second portion of the cylindrical coil conductor, and a physical length of said second antenna element in said direction is greater than a physical length of said second portion in said direction.

9. An antenna in accordance with claim 1, wherein the second antenna element is a substantially straight, filamentous conductor.

10. An antenna in accordance with claim 9, wherein the second antenna element comprises an insulating layer covering said substantially straight, filamentous conductor.

11. An antenna in accordance with claim 1, wherein the second antenna element comprises an insulating plate and an electrically conductive pattern formed on a surface thereof.

12. An antenna in accordance with claim 11, wherein said electrically conductive pattern comprises a widening for the formation of an electrical connection between said electrically conductive pattern and the cylindrical coil conductor at said junction.

13. An antenna in accordance with claim 11, wherein said electrically conductive pattern comprises, as a radiating antenna element, a substantially straight conductor portion.

14. An antenna in accordance with claim 11, wherein said electrically conductive pattern comprises, as a radiating antenna element, a conductor portion having at least one bend.

15. An antenna in accordance with claim 1, wherein at the junction, the diameter of the cylindrical coil turns of the cylindrical coil conductor is smaller than in said first and second portions.

16. An antenna in accordance with claim 1, wherein at said junction, the diameter of the cylindrical coil turns of the cylindrical coil conductor is the same as in said first and second portions.

17. An antenna in accordance with claim 1, wherein the second antenna element is a cylindrical coil conductor forming a helical antenna.

18. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, said second antenna element including an insulating plate and an electrically conductive pattern formed on a surface thereof, said electrically conductive pattern comprises, as a radiating antenna element, a conductor portion having at least one bend.

19. An antenna in accordance with claim 18, wherein said second antenna element is oriented in the same direction from said junction as the second portion of the cylindrical coil conductor, and a physical length of said second antenna element in said direction is substantially the same as a physical length of said second portion in said direction.

20. An antenna in accordance with claim 18, wherein said second antenna element is oriented in the same direction from said junction as the second portion of the cylindrical coil conductor, and a physical length of said second antenna element in said direction is greater than a physical length of said second portion in said direction.

21. An antenna in accordance with claim 18, wherein the first portion of the cylindrical conductor comprises a first end as a feed point of the antenna and a second end facing said junction.

22. An antenna in accordance with claim 18, wherein the second antenna element is a substantially straight, filamentous conductor.

23. An antenna in accordance with claim 22, wherein the second antenna element comprises an insulating layer covering said substantially straight, filamentous conductor.

24. An antenna in accordance with claim 18, wherein said electrically conductive pattern comprises a widening for the formation of an electrical connection between said electrically conductive pattern and the cylindrical coil at said junction.

25. An antenna in accordance with claim 18, wherein said electrically conductive pattern comprises, as a radiating antenna element, a substantially straight conductor portion.

26. An antenna in accordance with claim 18, wherein at the junction, the diameter of the cylindrical coil turns of the cylindrical coil conductor is smaller than in said first and second portions.

27. An antenna in accordance with claim 18, wherein at said junction, the diameter of the cylindrical coil turns of the cylindrical coil conductor is the same as in said first and second portions.

28. An antenna in accordance with claim 1, wherein the second antenna element is a cylindrical coil conductor forming a helical antenna.

29. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, said second antenna having an end disposed proximate the junction, said second antenna element including an insulating plate and an electrically conductive pattern formed on a surface thereof, said electrically conductive pattern comprises, as a radiating antenna element, a conductor portion having at least one bend.

30. An antenna for the transmission and reception of radio-frequency oscillation in two frequency ranges, comprising:

a cylindrical coil conductor forming a helical antenna and having a longitudinal axis, said cylindrical coil conductor including a first portion and a second portion, said first and second portions being disposed along said longitudinal axis; and a second antenna element fixedly connected to said cylindrical coil conductor at a junction disposed between said first and second portions of said cylindrical coil conductor, and the first portion of said cylindrical coil conductor having a first end as a feed point connection of said antenna, said second antenna element including an insulating plate and an electrically conductive pattern formed on a surface thereof, said electrically conductive pattern comprises, as a radiating antenna element, a conductor portion having at least one bend.

31. An antenna for the transmission and reception of radio-frequency oscillation at a first operating frequency and a second operating frequency different from said first operating frequency, comprising:

a cylindrical coil conductor forming a helical antenna and having a longitudinal axis, said cylindrical coil conductor including a first portion and a second portion, said first and second portions being disposed along said longitudinal axis and each having an electrical length, wherein the first operating frequency is dependent on the combined electrical length of said first and second portions; and a second antenna element having an electrical length, said second antenna element being fixedly connected to said cylindrical coil conductor at a junction disposed between said first and second portions of said cylindrical coil conductor; and the second operating frequency is dependent on the combined electrical lengths of the first portion and said second antenna element, said second antenna element including an insulating plate and an electrically conductive pattern formed on a surface thereof, said electrically conductive pattern comprises, as a radiating antenna element, a conductor portion having at least one bend.

32. An antenna in accordance with claim 31, wherein a bandwidth of the first operating frequency and a bandwidth of the second operating frequency are dependent on positioning of said junction in said cylindrical coil conductor along said longitudinal axis.

33. An antenna in accordance with claim 32, wherein the bandwidth of the first operating frequency decreases while the bandwidth of the second operating frequency increases as said junction is shifted along the longitudinal axis towards the first portion.

34. An antenna in accordance with claim 32, wherein the bandwidth of the first operating frequency increases while the bandwidth of the second operating frequency decreases as said junction is shifted along the longitudinal axis towards the second portion.

35. An antenna in accordance with claim 1, wherein the first portion of the cylindrical conductor comprises a first end as a feed point of the antenna and a second end facing said junction.

* * * * *